US008292411B2

(12) United States Patent
Anderson, Jr. et al.

(10) Patent No.: US 8,292,411 B2
(45) Date of Patent: Oct. 23, 2012

(54) MULTI-COLOR INK TANK WITH ELEMENTS ENABLING COMPATIBILITY WITH A SUPPORT STRUCTURE FOR INDIVIDUAL DIFFERENT COLOR IN TANKS

(75) Inventors: James Daniel Anderson, Jr., Harrodsburg, KY (US); Jeffery James Buchanan, Lexington, KY (US); Gina Marie Johns, Nicholasville, KY (US); Christopher Elliott Lingle, Lexington, KY (US); Jason Todd McReynolds, Georgetown, KY (US); Jerry Earl Stokesbary, Fishers, IN (US); Jason Todd Vanderpool, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1029 days.

(21) Appl. No.: 12/260,318

(22) Filed: Oct. 29, 2008

(65) Prior Publication Data

US 2010/0103230 A1 Apr. 29, 2010

(51) Int. Cl.
*B41J 2/175* (2006.01)

(52) U.S. Cl. ..... 347/85

(58) Field of Classification Search ..... 347/85, 347/84, 86, 87, 89
See application file for complete search history.

(56) References Cited

U.S. PATENT DOCUMENTS

| | | | |
|---|---|---|---|
| 6,631,978 | B1 | 10/2003 | Watanabe |
| 2005/0168549 | A1 | 8/2005 | Shinada |
| 2006/0012634 | A1 | 1/2006 | Squie |
| 2007/0268344 | A1 | 11/2007 | Anderson |

*Primary Examiner* — Kristal Feggins

(57) ABSTRACT

A multi-color ink tank is adapted to replace individual different color ink tanks in a cavity of a given support structure. Elements on the body of the multi-color ink tank have configurations enabling compatibility with the support structure. The elements include empty opposite side portions of the body defining laterally spaced apart bottom openings that adapt the opposite side portions to seat in spaced slots in the cavity over keys therein and an intermediate central recessed region defined between the opposite side portions that adapts the body to straddle an intermediate slot between the spaced slots and a key therein and also straddle partitions in the cavity forming the slots. The elements also include tabs blocking some latches used to releasably lock some individual ink tanks to thereby identify the latch to be used to releasably lock the multi-color ink tank.

14 Claims, 3 Drawing Sheets

MULTI-COLOR INK TANK WITH ELEMENTS ENABLING COMPATIBILITY WITH A SUPPORT STRUCTURE FOR INDIVIDUAL DIFFERENT COLOR IN TANKS

BACKGROUND

1. Field of the Invention

The present invention relates generally to inkjet printing systems and, more particularly, to a multi-color ink tank with elements enabling compatibility with a support structure for individual different color ink tanks.

2. Description of the Related Art

A conventional inkjet printing system forms an image on a print medium by ejecting ink from a plurality of ink jetting nozzles of an inkjet printhead to form a pattern of ink dots on the print medium. Inkjet printing is accomplished without contact between the printing system and the print medium. Such printing system typically includes a receptacle-like support structure mounted to a reciprocating carrier of the printing system. The carrier support structure permanently or at least semi-permanently mounts the inkjet printhead and also removably supports one or more ink containers or tanks in which ink is stored and from which ink is supplied to the printhead. The ink tanks when seated within the carrier support structure are engaged in a sealed ink supplying relationship with the printhead but may be removed and replaced once the ink is fully consumed during the printing operation.

In one embodiment of such inkjet printing system, a plurality of, and more particularly four, replaceable ink tanks are employed for supplying a corresponding plurality of printheads. Each tank contains ink of a different color and is adapted to be seated in a different one of multiple slots defined in the carrier support structure. Typically, the different colors are black (or mono), yellow, cyan and magenta. There are ribs or partitions in the carrier support structure separating the different slots from one another. Also, there are different keys in the slots adapting a given slot to receive and seat only a given one of the different color ink tanks. If the wrong color ink tanks are inserted in the wrong slots, cross-contamination of printheads can result. In another embodiment, there are two ink tanks employed in a different carrier support structure, one tank containing black ink and the other tank a multi-color, and more particularly a tricolor, ink tank having multiple, and more particularly three, separated interior spaces or compartments holding the other different color inks.

It would be desirable to be able to seat either the set of individual different color ink tanks or the one multi-color ink tank interchangeably in the respective slots of the same carrier support structure. This would decrease costs by reducing the number of different configurations of carrier support structures and/or ink tanks required for different printing systems.

The carrier support structure for seating the individual different color ink tanks also typically employs a latch for each different ink tank which releasably locks with a lip on the ink tank when the tank is seated within its respective slot in the carrier support structure. The latch is color coded to make it easier for a user to be able to insert the correct colored ink tank into the correct slot. If both the individual different color ink tanks and a single multi-color ink tank are to be made compatible with the same carrier support structure, it would be desirable to make it simple for users to select which one of different color coded individual latches is the correct one to actuate to unlock the multi-color ink tank for facilitating its easy removal and replacement.

Thus, there is a need for an innovation that will enable compatibility of the set of individual different color ink tanks and the multi-color ink tank with the same carrier support structure.

SUMMARY OF THE INVENTION

The present invention meets this need by providing an innovation that involves incorporation of certain elements on the body of the multi-color, and more particularly tricolor, ink tank which enables it to be compatible with the presence of ribs or partitions forming, and keys in, the slots of the given carrier support structure. The ribs or partitions were originally provided to form the slots in the support structure and the keys were originally provided to ensure the insertion of the correct individual colored ink tanks into the correct slots in the support structure. The multi-color ink tank now also inserts into the given support structure originally meant to support the individual different color ink tanks. Also, certain other elements now incorporated on the body permits the tricolor ink tank to identify which one of the existing latches of the support structure is to be actuated to remove the tricolor ink tank from the support structure.

Accordingly, in an aspect of the present invention, a multi-color ink tank includes a body, a plurality of separate compartments formed in the body for containing respectively therein different colors of ink corresponding to different colors of ink contained in a plurality of individual ink tanks that seat in a housing cavity of a given support structure, and a plurality of elements formed on the body with configurations enabling compatibility with the given support structure by adapting the body to releasably seat in the housing cavity of the given support structure in place of the plurality of individual different color ink tanks.

In further aspect of the present invention, the plurality of elements on the body comprise opposite side portions of the body at one end thereof having configurations that adapt the body to seat in the housing cavity in place of the plurality of individual different color ink tanks. The opposite side portions of the body have protuberances thereon projecting through at least some of a plurality of openings in the housing of the given support structure at a first end thereof when the body is seated in the housing cavity in place of the individual different color ink tanks. The plurality of elements on the body further comprise tabs mounted on the body at an opposite end thereof so as to at least partially block most of a plurality of latches mounted on a second end of the given support structure opposite the first end thereof and leave unblocked and thereby identify the one of the latches to be used in cooperation with the protuberances on the opposite side portions of the body to releasably lock the body seated in the housing cavity in place of the individual different color ink tanks. The plurality of elements also takes the form of a lower intermediate central recessed region between the opposite side portions of the body adapting the opposite side portions to seat in spaced slots in the housing cavity and adapting the body at the lower intermediate central recessed region to straddle an intermediate slot between the spaced slots in the housing cavity and also straddle partitions in the housing cavity forming the slots therein.

BRIEF DESCRIPTION OF THE DRAWINGS

Figure 1:
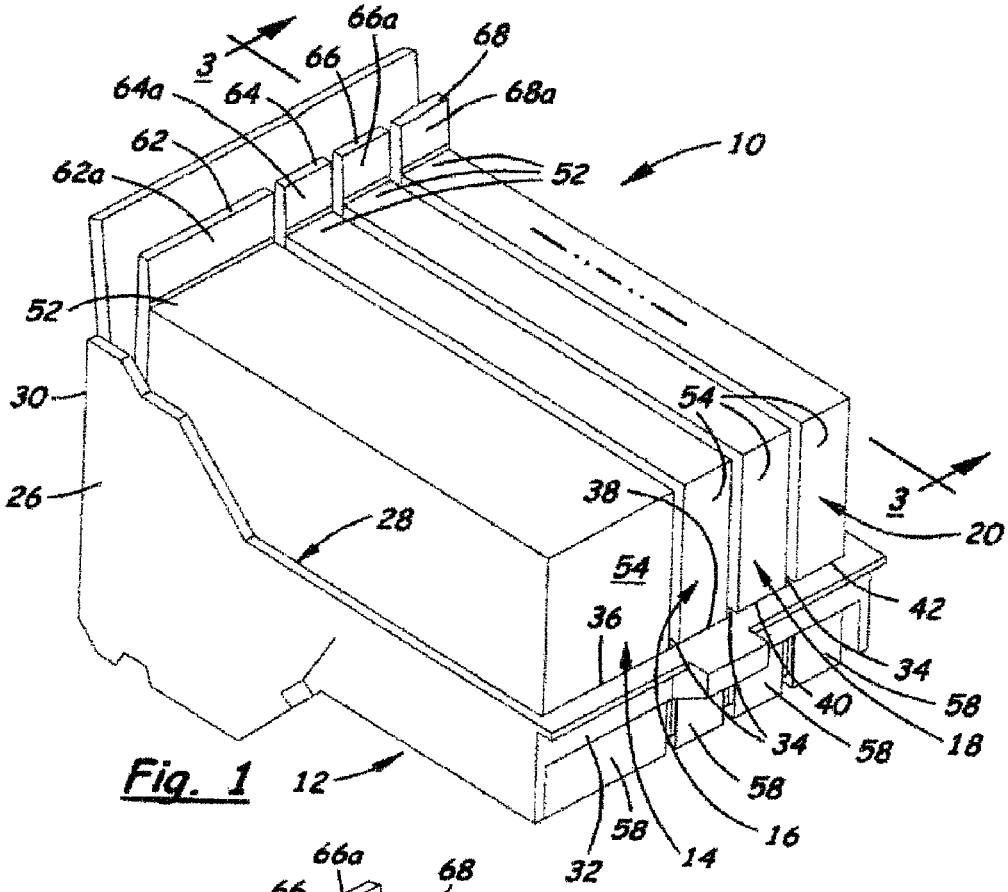

Having thus described the invention in general terms, reference will now be made to the accompanying drawings, which are not necessarily drawn to scale, and wherein:

FIG. 1 is a perspective view of an ink tank system showing a carrier support structure with a plurality of individual different color ink tanks installed therein.

Figure 2:
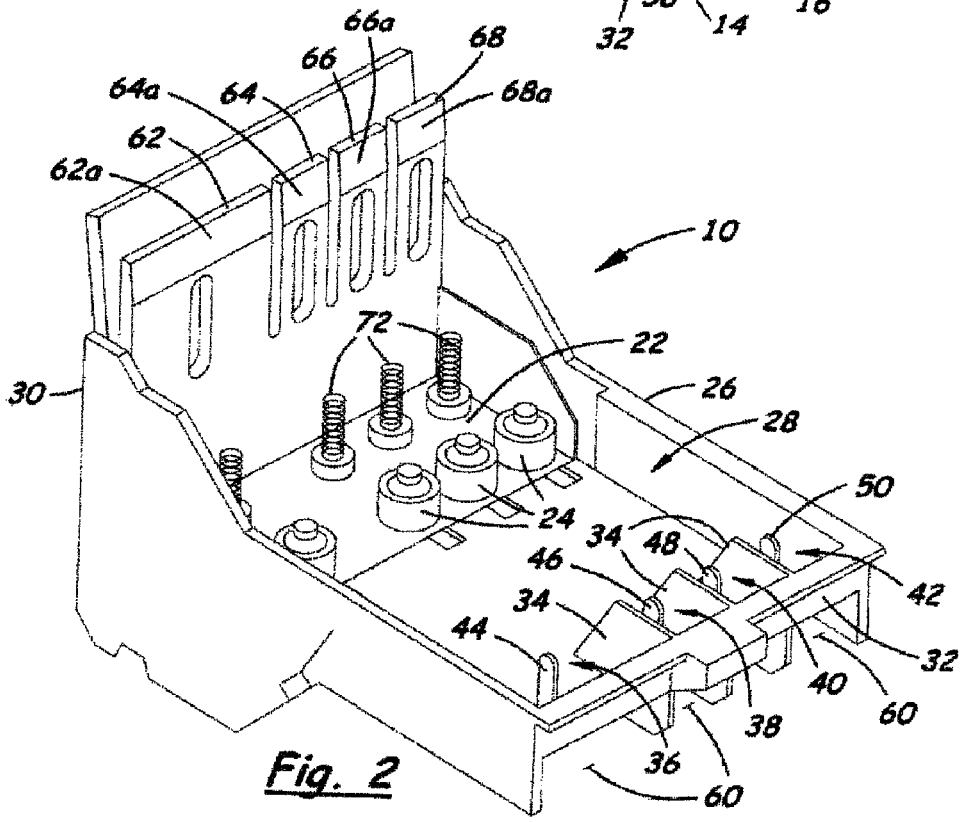

FIG. 2 is a perspective view of the carrier support structure of the ink tank system of FIG. 1 without the individual different color ink tanks.

Figure 3:
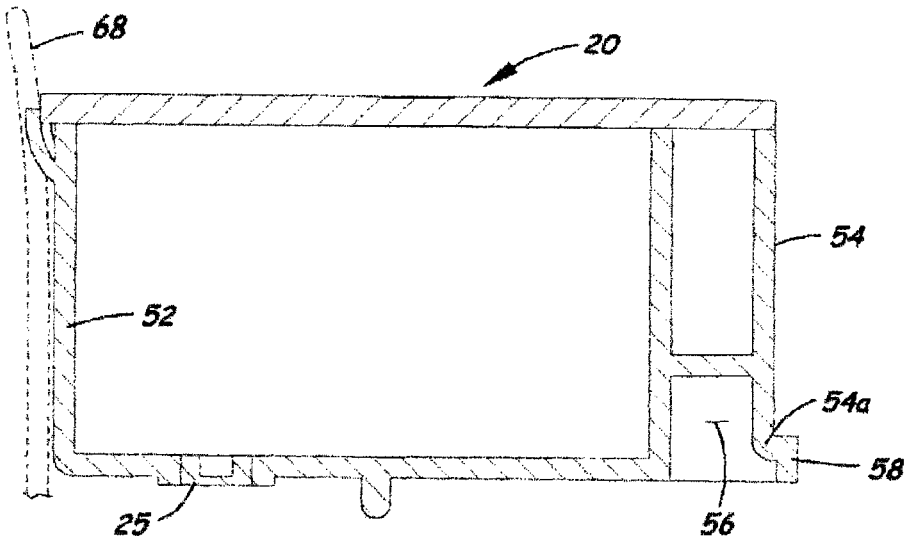

FIG. 3 is a longitudinal sectional view of one of the individual different color ink tanks of the ink tank system taken along line 3-3 of FIG. 1.

Figure 4:
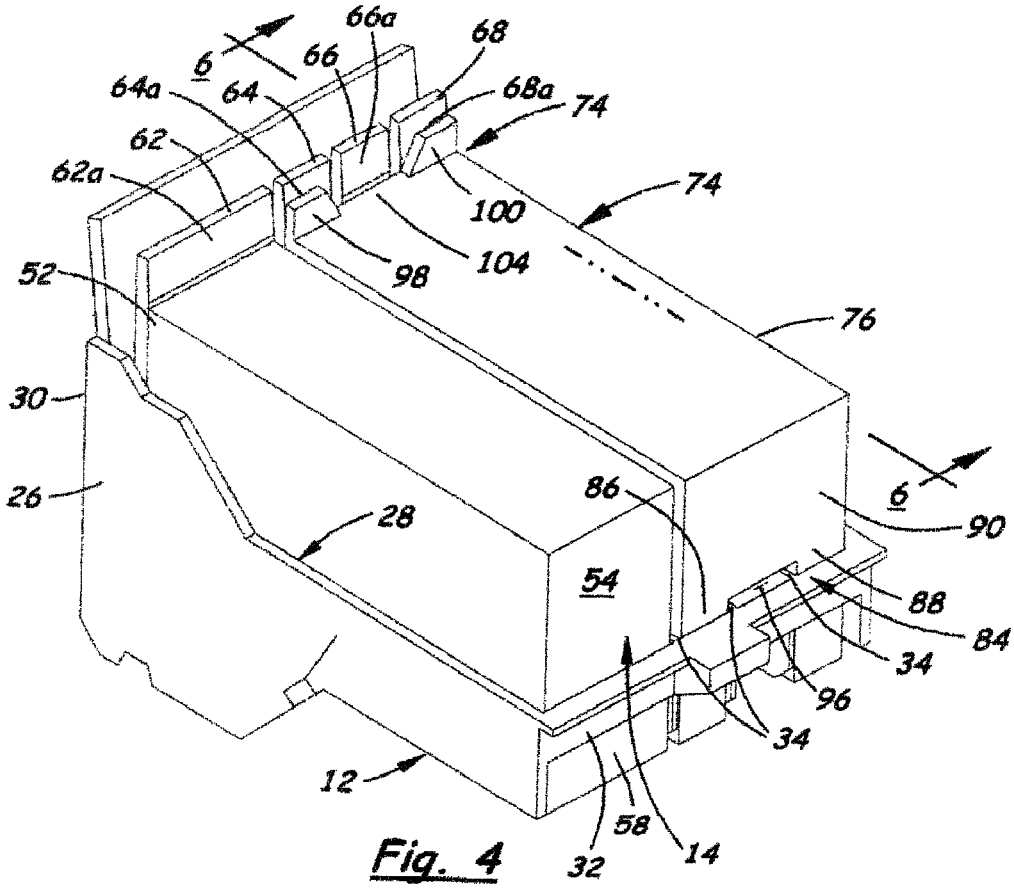

FIG. 4 is a perspective view of an ink tank system with a multi-color ink tank in accordance with the present invention.

Figure 5:
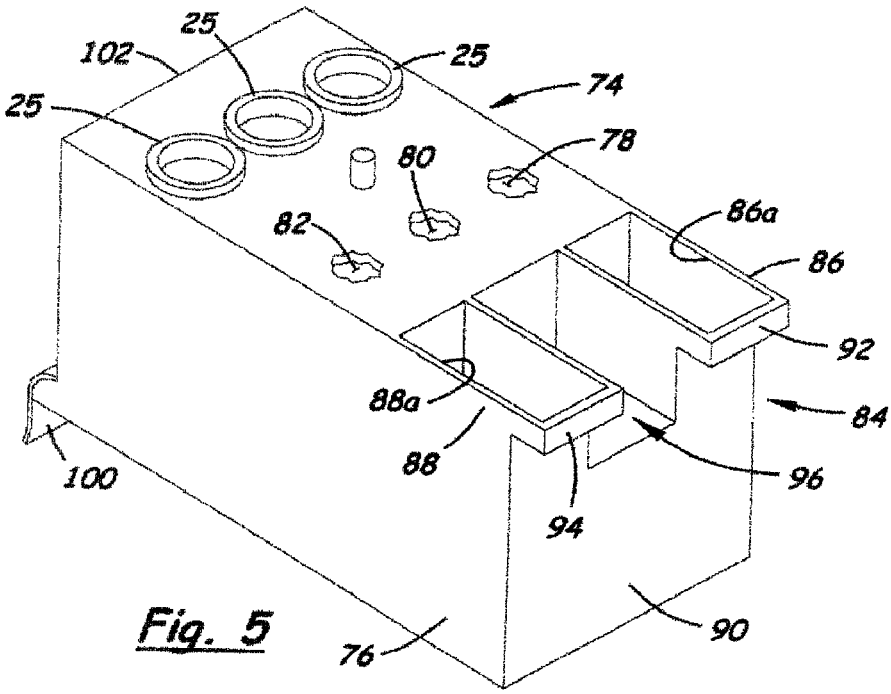

FIG. 5 is an inverted perspective view of the multi-color ink tank of the ink tank system of FIG. 4.

Figure 6:
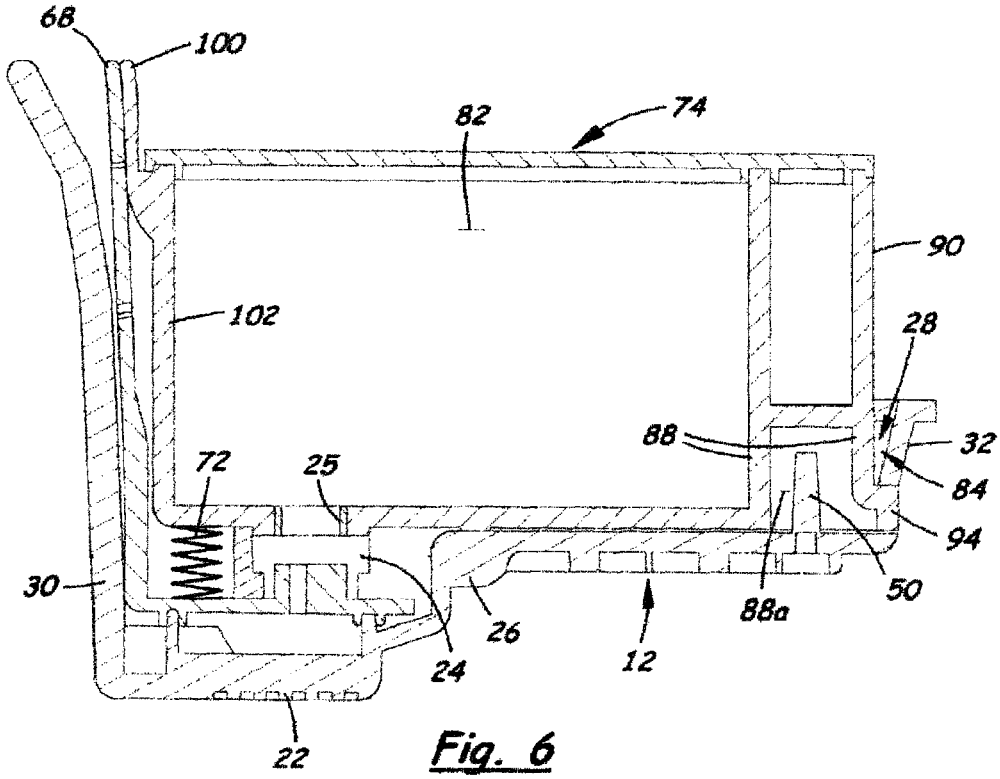

FIG. 6 is a longitudinal sectional view of the ink tank system taken along line 6-6 of FIG. 4.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to the drawings and particularly to FIG. 1, there is illustrated an ink tank system, generally designated 10, which includes a receptacle-like carrier support structure 12 and a mono color ink tank 14 and a plurality of individual different color ink tanks 16, 18, 20 installed in the support structure 12. It is by way of example, and not as a limitation, that in the illustrated embodiment there are four individual different color ink tanks 14-20. Also, by way of example, and not as a limitation, the one individual ink tank 14 holds a black (or mono) color ink; and the plurality of other individual ink tanks 16-20 hold yellow, cyan and magenta colors of ink. The black color ink tank 14 is larger than the other color ink tanks 16-20 so that it can hold a larger quantity of black ink, as most users use more black ink than other ink colors. Ink tanks 14-20 holding other combinations of ink colors may be employed within the scope of the present invention. However, the combination of ink colors in the tanks 14-20 in the illustrated embodiment is one that is widely used.

Referring to FIG. 2, the support structure 12 is shown without the ink tanks 14-20. The support structure 12 is typically mounted to a reciprocating carriage or carrier (not shown) of a printing system. The support structure 12 permanently or at least semi-permanently mounts the one or more inkjet printheads 22, as seen FIG. 6, in addition to removably supporting the ink tanks 14-20, as seen in FIG. 1, in which ink is stored and from which ink is supplied to the printheads 22 through interfittable orifices 24, 25, as seen in FIGS. 2 and 6. The ink tanks 14-20 when seated within the support structure 12 are engaged in a sealed ink supplying relationship with the printheads 22 but may be removed and replaced once the ink is fully consumed during the printing operation.

More particularly, as best seen in FIG. 2, the support structure 12 has a housing 26 defining a cavity 28 therein extending between front and rear ends 30, 32 thereof. There is a plurality of ribs or partitions 34 formed on the housing 26 and disposed upright in the cavity 28 so as to define and separate a plurality of different slots 36, 38, 40, 42 from one another in the cavity 28. Also, there is a plurality of different keys 44, 46, 48, 50 formed on the housing 26 and disposed upright in the respective slots 36-42 in the cavity 28 which adapts a given one of the slots 36-42 to receive and seat only a given one of the different color ink tanks 14-20, as seen in FIG. 1. The keys 44-50 thus are provided to prevent the wrong ink tank 14-20 from being inserted into the wrong slot 36-42 which would cause cross-contamination of the printheads 22.

Referring to FIG. 3, the internal configuration of each of the ink tanks 14-20 is depicted spanning from a front end 52 to a rear end 54 thereof. Each ink tank 14-20 has a lower recess 56 adapted to receive and accommodate a respective one of the keys 44-50 associated with that particular one of the ink tanks 14-20. Also, a foot-like protuberance 58 protrudes from the lower edge portion 54*a* of the rear end 54 of each of the ink tanks 14-20 through one opening 60 in a row of side-by-side openings 60 across the lower rear end 32 of the support structure 12. Also, the support structure 12 for releasably locking the individual different color ink tanks 14-20 in the slots 36-42 of the housing cavity 28 typically employs a plurality of resiliently yieldable or deflectable latches 62, 64, 66, 68, each for a different one of the ink tanks 14-20. Each of the latches 62-68, in cooperation with the foot-like protuberance 58 on the lower rear end 54 of a respective one of the ink tanks 14-20 and when releasably engaged or snap fitted with a lip 70 on the upper front end 52 of the respective one of the ink tanks 14-20 and also against the force of a spring 72 when the latter is compressed between the housing 26 and the respective one of the ink tanks 14-20, releasably locks the respective one of the tanks 14-20 in a seated position within its respective one of the slots 36-42 in the support structure 12. The deflectable latches 62-68 are color coded on their faces 62*a*-68*a* to make it easier for a user to be able to select the correct latch 62-68 and deflect it forwardly to enable insertion or removal of the correct color ink tank 14-20 into and from the correct slot 36-42.

Referring now to FIGS. 4-6, there is illustrated a single multi-color, or more particularly a tricolor, ink tank 74 of the present invention. The multi-color ink tank 74 includes a body 76 and a plurality of separate compartments 78, 80, 82 for containing respectively therein the different colors of ink, namely, yellow, cyan and magenta colors, corresponding to the same different colors of ink contained in the plurality of individual different color ink tanks 16-20. In accordance with the present invention, the body 76 of the multi-color ink tank 74 also includes a plurality of elements, generally designated 84, formed thereon enabling compatibility with the carrier support structure 12 by adapted the body 76 to releasably seat in the housing cavity 28 of the support structure 12 in place of the plurality of individual different color ink tanks 16-20. The one black or mono color ink tank 14 is not affected; it remains installed in its one slot 36 in the housing cavity 28 regardless of whether the plurality of individual different color ink tanks 16-20 or multi-color ink tank 74 are installed in the support structure 12.

More particularly, some of the plurality of elements 84 on the body 76 of the multi-color ink tank 74 are in the form of the opposite side portions 86, 88 of the body 76 at the rear end 90 thereof whose configuration adapts the body 76 to seat in the slots 38 and 42 in the housing cavity 28 in place of the plurality of individual different color ink tanks 16-20. The opposite side portions 86, 88 of the body 76 have respective protuberances 92, 94 thereon projecting through at least some, namely two, of the plurality of openings 60 in the lower rear end 32 of the housing 26 of the support structure 12 when the body 76 of the multi-color ink tank 74 is seated in the housing cavity 28 in place of the plurality of individual different color ink tanks 16-20. The opposite side portions 86, 88 of the body 76 also are empty and have bottom openings 86*a*,

88*a* to accommodate projection therein of the keys 46, 50 mounted on the housing 26 in the slots 38, 42.

Additionally, another of the plurality of elements 84 on the body 76 of the multi-color ink tank 74 takes the form of the lower intermediate central recessed region 96 between the opposite side portions 86, 88 of the body 76 whose configuration adapts the opposite side portions 86, 88 to seat in the spaced slots 38, 42 in the housing cavity 28 and adapts the portion of the body 76 immediately above the lower intermediate central recessed region 96 to straddle the intermediate slot 40 between the spaced slots 38, 42 in the housing cavity 28 and also straddle the partitions 34 in the housing cavity 28 forming the slots 38, 40, 42 therein. Also, the recessed region 96 accommodates the projection therein of the key 48 mounted on the housing 26 in the intermediate slot 40.

Finally, still others of the plurality of elements 84 on the body 76 of the multi-color ink tank 74 take the form of spaced apart tabs 98, 100 mounted on the body 76 at the opposite front end 102 thereof. The tabs 98, 100 at least partially block most of the color coded faces 64*a*, 68*a* on the latches 64, 68 mounted on the front end 30 of the given support structure 12. The spaced apart relationship of the tabs 98, 100 leave unblocked enough of the color coded faces 64*a*, 68*a* on the latches 64, 68 which are not used to release the multi-color ink tank 74 and entirely unblocked all of the color coded face 66*a* of the center one latch 66 to make it easy for a user to thereby identify the latch 66 as the one to be used, by being deflected forwardly away from the ink tank 74, to release the ink tank 74. The latch 66 when left undeflected will, in cooperation with the protuberances 92, 94 on the opposite side portions 86, 88 of the body 76 and the snap-fitted lip 104 on the upper front edge 76*a* of the body 76 and against the compressed springs 72, releasably lock the body 76 of the multi-color ink tank 74 seated in the slots 38-42 of the housing cavity 29 in place of the plurality of individual different color ink tanks 16-20.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A multi-color ink tank, comprises:

a body;

a plurality of separate compartments formed in said body for containing respectively therein different colors of ink corresponding to different colors of ink contained in a plurality of individual ink tanks that seat in a housing cavity of a given support structure; and a plurality of elements formed on said body with configurations enabling compatibility with the given support structure by adapting said body to releasably seat in the housing cavity of the given support structure in place of the plurality of individual different color ink tanks, wherein said plurality of elements on said body comprise opposite side portions of said body at one end thereof and a lower intermediate central recessed region between said opposite side portions adapting said opposite side portions to seat in spaced slots in the housing cavity and said body at said lower intermediate central recessed region to straddle an intermediate slot between the spaced slots in the housing cavity and also straddle partitions in the housing cavity forming the slots therein.

2. The tank of claim 1 wherein said opposite side portions of said body have protuberances thereon projecting through at least some of a plurality of openings in the housing of the given support structure at a first end thereof when said body is seated in the housing cavity in place of the individual different color ink tanks.

3. The tank of claim 2 wherein said plurality of elements on said body further comprise tabs mounted on said body at an opposite end thereof so as to at least partially block most of a plurality of latches mounted on a second end of the given support structure opposite the first end thereof and leave unblocked and thereby identify the one of said latches to be used in cooperation with said protuberances on said opposite side portions of said body to releasably lock said body seated in the housing cavity in place of the individual different color ink tanks.

4. A multi-color ink tank, comprises:

a body;

a plurality of separate compartments formed in said body for containing respectively therein different colors of ink corresponding to different colors of ink contained in a plurality of individual ink tanks that seat in a housing cavity of a given support structure; and a plurality of elements formed on said body with configurations enabling compatibility with the given support structure by adapting said body to releasably seat in the housing cavity of the given support structure in place of the plurality of individual different color ink tanks, wherein said plurality of elements on said body comprise empty opposite side portions of said body at one end thereof defining bottom openings and a lower intermediate central recessed region between said opposite side portions adapting said opposite side portions to seat in spaced slots in the housing cavity and overlie keys in the spaced slots and said body at said lower intermediate central recessed region to straddle an intermediate slot between the spaced slots and also straddle a key in the intermediate slot and partitions in the housing cavity forming the slots.

5. The tank of claim 4 wherein said empty opposite side portions of said body have protuberances thereon projecting through at least some of a plurality of openings in the housing of the given support structure at a first end thereof when said body is seated in the housing cavity in place of the individual different color ink tanks.

6. The tank of claim 5 wherein said plurality of elements on said body further comprise tabs mounted on said body at an opposite end thereof so as to at least partially block most of a plurality of latches mounted on a second end of the given support structure opposite the first end thereof and leave unblocked and thereby identify the one of said latches to be used in cooperation with said protuberances on said empty opposite side portions of said body to releasably lock said body seated in the housing cavity in place of the individual different color ink tanks.

7. The tank of claim 4 wherein said body has protuberances thereon projecting through at least some of a plurality of openings in the housing of the given support structure at a first end thereof when said body is seated in the housing cavity in place of the individual different color ink tanks.

8. The tank of claim 7 wherein said plurality of elements on said body comprise tabs mounted on said body so as to at least partially block most of a plurality of latches mounted on a second end of the given support structure opposite the first end thereof and leave unblocked and thereby identify the one of said latches to be used to releasably lock said body seated in the housing cavity in place of the individual different color ink tanks.

9. A multi-color ink tank configured to be removably inserted into an ink jet printer, the printer having a support structure having a housing that defines a cavity for seating a plurality of individual color ink tanks, the multi-color ink tank, comprising:

a body;

a plurality of separate compartments formed in said body for containing respectively therein different colors of ink corresponding to different colors of ink contained in a plurality of individual ink tanks that seat in said cavity of said housing, and a plurality of elements formed on one of said housing or said body enabling compatibility between said support structure and said body adapting said body to seat in said cavity of said housing of said support structure in place of the plurality of individual different color ink tanks, wherein said support structure also has a plurality of partitions mounted on said housing in laterally spaced apart relationship to one another in said cavity of said housing to form a plurality of slots in said cavity of said housing between adjacent ones of said partitions in which to seat the plurality of individual different color ink tanks and wherein said plurality of elements on said body comprise opposite side portions of said body at one end thereof defining laterally spaced apart bottom openings adapting said opposite side portions to seat in spaced ones of said slots and a lower intermediate central recessed region defined between said opposite side portions adapting said body to straddle an intermediate one of said slots between said spaced slots and also straddle said partitions in said housing cavity forming said slots.

10. The tank of claim 9, wherein said support structure further has keys mounted on said housing and extending upright in said slots in said housing cavity so as to ensure correct seating of the individual different color ink tanks in said slots.

11. The tank of claim 9 wherein said support structure at a first end has a plurality of openings formed in said housing side-by-side one another and communicating with said cavity of said housing such that a protuberance on each of the individual different color ink tanks is adapted to extend through one of said openings when the individual different color ink tanks are seated in said cavity of said housing.

12. The tank of claim 11, wherein said opposite side portions of said body have protuberances thereon projecting through at least some of said openings in said housing at said first end thereof when said body is seated in said cavity of said housing in place of the individual different color ink tanks.

13. The tank of claim 12 wherein said support structure at a second end opposite said first end thereof has a plurality of latches mounted on said housing, each of said latches in cooperation with said protuberance on one of the individual different color ink tanks releasably locking the one of the individual different color ink tanks in said cavity of said housing when the individual different color ink tanks are seated in said cavity of said housing.

14. The tank of claim 13, wherein said plurality of elements on said body comprise tabs mounted on said body at an opposite end thereof so as to at least partially block most of said latches and leave unblocked and thereby identify the one of said latches to be used to releasably lock said body in said cavity of said housing in place of the individual different color ink tanks.

* * * * *